United States Patent [19]

Maeda

[11] 4,313,545

[45] Feb. 2, 1982

[54] METALLIC PRESSURE VESSEL WITH THIN WALL

[75] Inventor: Kenichi Maeda, Neyagawa, Japan

[73] Assignee: The Nippon Aluminum Mfg. Co., Ltd., Osaka, Japan

[21] Appl. No.: 118,108

[22] Filed: Feb. 4, 1980

[30] Foreign Application Priority Data

| | | | |
|---|---|---|---|
| Feb. 13, 1979 | [JP] | Japan | 54-15892 |
| Oct. 8, 1979 | [JP] | Japan | 54-130205 |
| Oct. 9, 1979 | [JP] | Japan | 54-130535 |
| Oct. 9, 1979 | [JP] | Japan | 54-139959[U] |
| Nov. 5, 1979 | [JP] | Japan | 54-143641 |

[51] Int. Cl.[3] ..... B65D 8/08; B65D 8/12; B65D 8/18

[52] U.S. Cl. ..... 220/1 BC; 220/67; 220/70; 220/72; 220/74; 413/73

[58] Field of Search ..... 220/66, 67, 70, 5 R, 220/72, 74, 3, DIG. 1, 1 BC, 458; 113/120 Z, 120 H; 222/402.24; 29/251

[56] References Cited

U.S. PATENT DOCUMENTS

| | | | |
|---|---|---|---|
| Re. 6,391 | 4/1875 | Segife | 220/72 |
| D. 246,229 | 11/1977 | Saunders | D9/351 |
| D. 250,933 | 1/1979 | Saunders | D9/351 |
| D. 254,957 | 5/1980 | Campbell et al. | D9/216 |
| 1,975,265 | 10/1936 | Fulenwider | 220/66 |
| 2,047,076 | 7/1936 | Kronquest | 220/1 BC X |
| 2,339,763 | 1/1944 | Calleson et al. | 220/1 BC X |
| 2,384,810 | 9/1945 | Calleson et al. | 220/66 X |
| 3,180,374 | 4/1965 | Muller | 222/396 |
| 3,217,936 | 11/1965 | Abplanalp | 222/402.24 |
| 3,501,043 | 3/1970 | Jernberg | 220/70 X |
| 3,519,171 | 7/1970 | Kinnavy | 222/394 |
| 3,738,537 | 6/1973 | Gaeh | D9/448 X |
| 3,759,410 | 9/1973 | Uhlis | 215/1 C |
| 3,832,962 | 9/1974 | Rolles | 220/458 X |
| 3,995,572 | 12/1976 | Saunders | 113/120 H |
| 4,175,670 | 11/1979 | Reynolds et al. | 220/70 |

FOREIGN PATENT DOCUMENTS

| | | | |
|---|---|---|---|
| 1155953 | 10/1963 | Fed. Rep. of Germany | 220/DIG. 1 |
| 2701827 | 7/1978 | Fed. Rep. of Germany | 220/72 |
| 633681 | 2/1928 | France | 220/1 BC |

*Primary Examiner*—Allan N. Shoap
*Attorney, Agent, or Firm*—Browdy and Neimark

[57] ABSTRACT

A metallic pressure vessel or container, made of a thin aluminum or aluminum alloy sheet coated with a resin suitably, used for a small size beer container. The vessel is composed of (a) a main body member of bottomed cylindrical form, with a bulge in the central part thereof precessed by a novel method, provided with at least three protrusions and recessed beads disposed therebetween alternately, for stable setting and reinforcing, and (b) a lid member, for covering the former body, which is made into an inverted bowl shape, with a mouth portion integrally formed for being crowned thereon, and provided with a plurality of small wave like patterns consisting of continuous and smooth hills and valleys. Those two parts are generally made by multiple deep-drawing processes and joined together by the double seaming method. The process of the mouth portion making is characteristic in its burling and curling processes.

11 Claims, 18 Drawing Figures

METALLIC PRESSURE VESSEL WITH THIN WALL

FIELD OF THE INVENTION

This invention relates to a metallic pressure vessel with thin wall, and more particularly to a pressure vessel with a mouth portion integrally formed of a metallic thin sheet or sheet metal consisting of aluminum or aluminum alloy, which vessel is suitably utilized as a small size beer barrel.

BACKGROUND OF THE INVENTION

Metallic vessels or containers are usually made by firmly connecting or joining a bottomed lower piece (main part of the container) of cylindrical form and an upper piece (lid part so to speak), with a mouth portion on top, of inverted bowl form downwardly open, at the abutting portion of the two. Those metallic vessels (containers) may be utilized in various purposes, and the most serious problem therein has been the heavy weight which they can hardly evade because of the metallic material. As a naturally thought countermeasure, a metal plate or slab of small thickness has been tried, but the thinner the metal plate becomes, the more often the pressure-resisting capacity of the container appears as a problem. Sometimes a deformation or buckling of the container happens during its actual use. In some other instances a too thin metal plate makes the formation of the lower piece or the upper piece itself very difficult, i.e., provides a problem of forming method.

On the other hand, vessels or containers made of aluminum or its alloys are widely used because of their strong points in light weight and corrosion resistance. Their good features, in being harmless to the contained matter because of the corrosion resistance and in being flexible in formation, allow them to be broadly utilized for containing foods or the like. When such a container of aluminum (or aluminum alloy) is utilized for beer container, it is required to be inner-pressure resistant in the order of 3-4 $Kg/cm^2$ because of beer being a foaming beverage. So the container of aluminum (or aluminum alloy) must be, while being required to be as thin as possible in its wall thickness within the allowable extent for the purpose of weight decreasing, sufficiently inner-pressure resisting and suitable for formation as well. This is an inherent and difficult problem to be solved for the container of this type.

Such a container, when it is used as a beer container for example, must be provided with a mouth portion in its upper piece for filling or emptying the contained liquid. However it becomes a very difficult problem to integrally form the mouth portion there when the wall thickness of the container is diminished to a certain limit.

SUMMARY OF THE INVENTION

It is a principal object of this invention to provide, considering the above-mentioned background in the field sufficiently, an excellent metallic pressure vessel made of a metallic material of small thickness.

It is another object of this invention to provide a metallic pressure vessel which is made of aluminum or aluminum alloy sheet, formed integrally with a mouth portion, excellent in pressure resistance, and suitable for a small size beer barrel.

It is still another object of this invention to economically provide a metallic pressure vessel which is well preventive of deformation and buckling during the use, excellent in pressure resistance, and superior in formability.

Other objects of this invention will become apparent to those skilled in the art from the following detailed description of the preferred embodiments when read in conjunction with the accompanying drawings.

A metallic pressure vessel of small wall thickness in accordance with this invention is characteristically composed of, for attaining those purposes, (a) a bottomed cylindrical main body piece of the container which is formed of a thin metallic plate or sheet by deep-drawing process to be outwardly swollen or bulged in arch shape in the vertical cross section, and (b) a lid piece of metallic thin plate, for being gas-tightly attached to the upper opening of the main body piece, which lid piece is consisted again of an inverted bowl shaped portion and a cylindrical mouth portion extending outwardly from the central part of the inverted bowl shaped portion, said inverted bowl shaped portion being gradually decreased in its diameter from the attached portion upwards and provided thereon with a plurality of concentric annular and smoothly continued wave like convex-and-concave patterns in its axial section passing the vessel center.

BRIEF DESCRIPTION OF THE DRAWINGS

FIGS. 5-11 are views for explaining the forming process of the lid piece with the mouth portion, in which, FIG. 5 is a partial cross sectional view of the lid piece after having finished the stepped drawing process;

FIG. 6 is an axial cross sectional view of the lid piece after having finished the punching process;

FIG. 7 is an axial cross sectional view of the mouth portion after having finished the burling process;

FIG. 8 is an axial cross sectional view of the mouth portion after having finished the curling process;

FIG. 9 is a perspective view of the mouth portion after an undesirable phenomenon has happened;

FIGS. 10 (*a*) and (*b*) are vertical cross sectional views of the mouth portion made from the state shown in FIG. 9;

FIG. 11 is an axial cross sectional view of the mouth portion after having finished the burling process recommended by this invention;

DETAILED DESCRIPTION OF THE PREFERRED EMBODIMENTS

Figure 1:
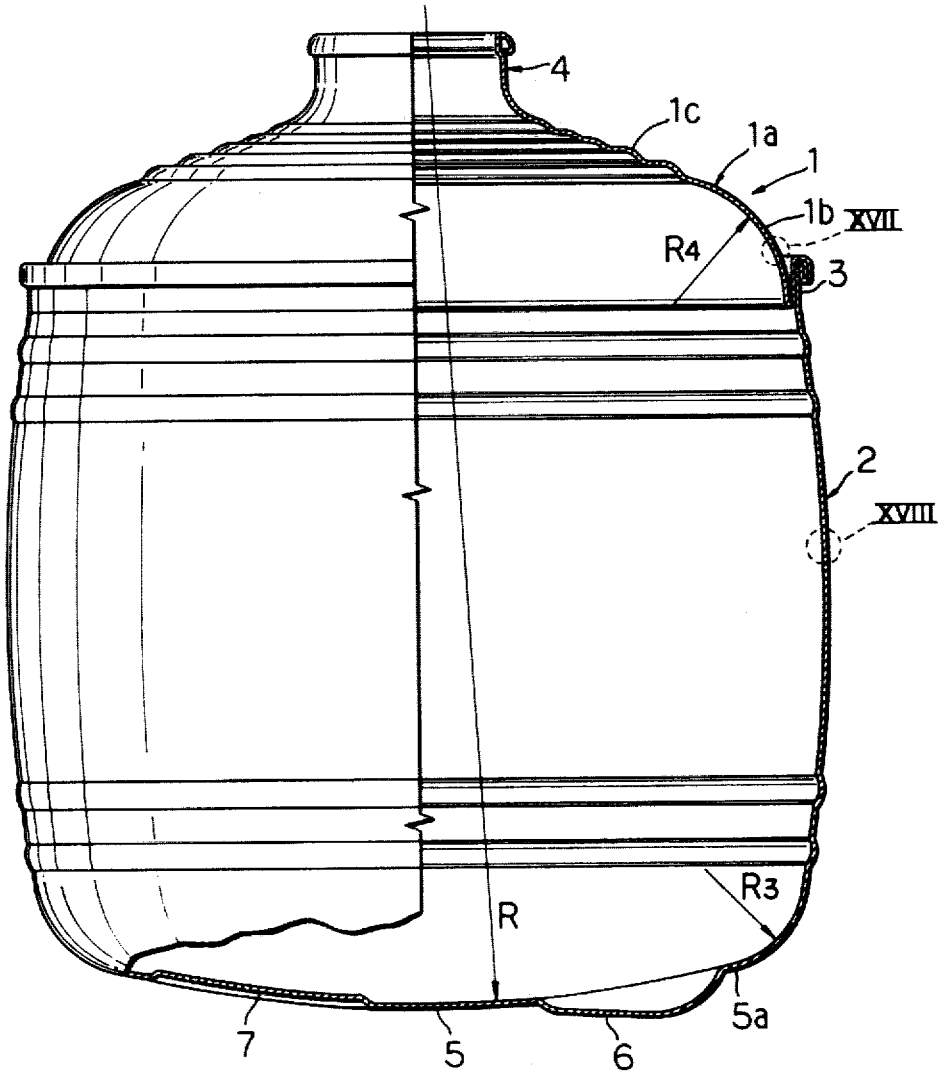
FIG. 1 is an elevational view, partially in axial cross section, of an embodiment of a small size beer-barrel in accordance with this invention.
Figure 17:
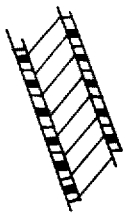
FIG. 17 is a blown-up cross-sectional view of the insert identified as XVII in FIG. 1.
Figure 18:
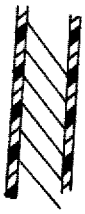
FIG. 18 is a blown-up cross-sectional view of the insert identified as XVIII in FIG. 1.

In FIG. 1 which illustrates an example wherein this invention is most preferably applied to a beer barrel, numeral 1 designates an upper piece (lid member) which consists of an inverted bowl shaped portion 1*a*, the diameter of which being gradually decreased from a lower part toward an upper part, and a mouth portion 4 of cylindrical form which is integrally formed with the inverted bowl shaped portion and extends from the central part of the inverted bowl shaped portion 1*a*. The upper piece (lid member) is made, by a forming process, of a thin plate or sheet of aluminum or aluminum alloy, of 0.3–1.0 mm preferably 0.3–0.5 mm, coated with epoxy resin (see FIG. 17), and the same includes a curved portion 1*b* with a predetermined radius of curvature $R_4$ and an annular waved portion 1*c* continued from the curved portion 1*b* (upwardly in FIG. 1), which is formed of a plurality of concentric wave like patterns, i.e., a series of continuous concentric convex-and-concave annular ridges and grooves, in its axial cross sectional view. The lower piece 2, which is joined to the upper piece 1, is formed of a metallic thin plate (thin sheet of aluminum alloy in this embodiment) coated with epoxy resin (see FIG. 18), processed by means of a deep-drawing process, into a cylindrical form having a bottom and outwardly bulged form like an arch in the cross sectional view of the barrel portion thereof.

The upper piece 1 and the lower piece 2 are placed in confrontation with the opening portion of either member to each other for being gas-tightly joined (fixed) at the circumferential portion of the two to be a desired pressure vessel.

The bottom portion 5 of the main body 2 (barrel) of the pressure vessel is also outwardly bulged with a predetermined radius of curvature R for forming a shallow bowl or saucer shape; and five dowels 6 (gentle protrusion) are formed as a protuberance arranged on a circular line about the center of the bottom portion 5 for stably contacting a table or stand on which it is to be placed. Those dowels 6 are for stably supporting the vessel filled with beer or other liquid and for preventing the vessel from being turned over, so they must be formed at least three in number. Between each pair of neighboring dowels 6, 6 is formed a radial bead 7 (concave recess) like a groove.

Figure 2:
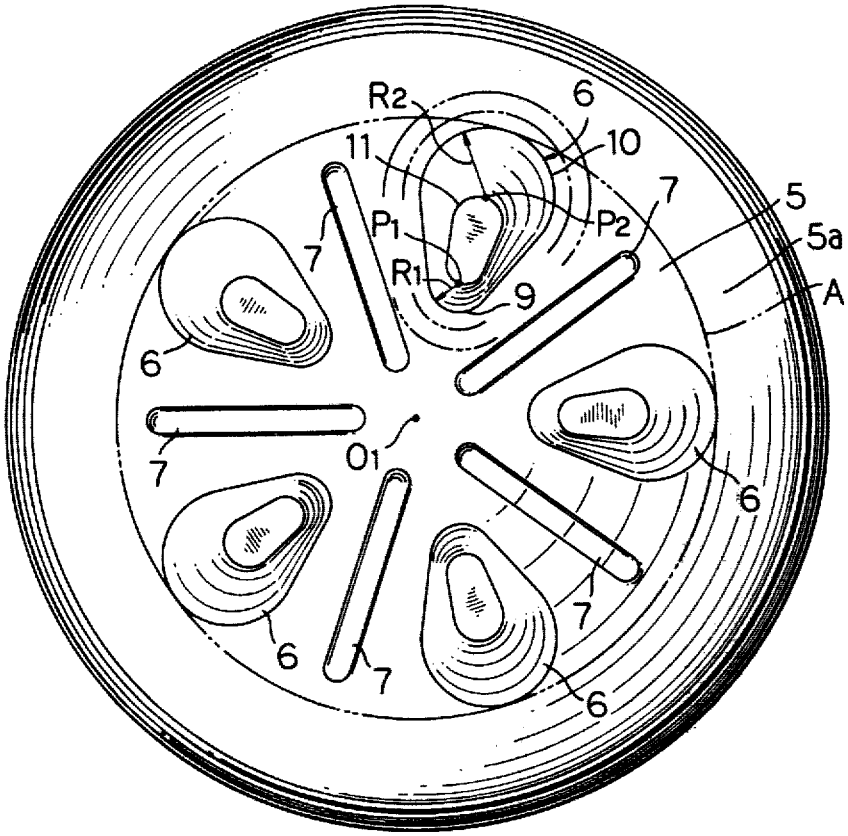
FIG. 2 is a bottom plan view of the above embodiment.

As can be clearly seen in FIG. 2 which shows the bottom 5 of the vessel, each dowel 6 has, as a whole, an outline of dew drop shape which is formed by linking an arc portion 9 described with a radius $R_1$ having its center at a point $P_1$ near the center $O_1$ of the bottom 5 and another arc 10 described with a radius $R_2$ ($R_2 > R_1$) having its center at a point $P_2$ farther from the center $O_1$ than the point $P_1$, and the contacting area 11 with the table to be placed on is of oval (ellipse) shape, so extending as to link the point $P_1$ with the point $P_2$ in a radial direction. The oval contacting area 11 is gently protruding, as a whole, downwardly from the bottom 5 to form a flat plateau. The bead 7 for reinforcing the bottom 5 radially extends starting from a point near the center $O_1$ almost reaching an enveloping circle A which links the outer periphery of each dowel 6. And the bead 7 is formed by partly recessing the bottom 5 upwardly to be a shallow and gentle groove of rectangular shape. The bottom 5 is, outside the enveloping circle A, curved with a suddenly diminished radius of curvature $R_3$ (FIG. 1) to be relatively large in strength there. Within the enveloping circle A a radius of curvature R (FIG. 1) of the bottom 5 is very large to make that portion rather non-susceptible to buckling in general.

In other words, as the vessel is supported on the table (stand) in this invention by the five dowels 6 formed in a part of the bottom 5, being reinforced by the bead 7 radially disposed between each pair of neighboring dowels 6, the dead load of the vessel itself and the load of the contained beer urging downwards the dowels 6 give a reactionary effect to the surrounding area about each dowel 6 (part of the bottom 5 except the area occupied by the dowels 6). So the surrounding area is liable to be inwardly recessed (caved in) concentrically, with the points $R_1$ and $R_2$ as a center, shown with two-dot-chain lines in FIG. 2. However, this probability of recessing, i.e., buckling in the two dot-chain-lined area can be mostly prevented by the action of the annular area 5*a* curved with the small radius of curvature $R_3$ outside the enveloping circle A and the beads 7. Mere disposing of the bead 7 between the neighboring dowels 6 is very much contributive to preventing the deformation of the vessel which might be developed in a circular area around the dowel 6. And such a bead 7 may be formed by outwardly (downwardly) protruding a part of the bottom 5, with the same desired effect.

This sort of metallic pressure vessel is preferably utilized as a small size beer container for containing 3–5 l beer. And in a case of a vessel for 3 l beer, for example, the height is approximately 200 mm and the largest barrel diameter is 165 mm or so.

In the upper piece 1, which is the most characteristically formed part of the vessel of this invention, the plurality of circular convex-and-concave patterns of continuous wave like shape in section enhances the pressure resistance to a great extent, irrespective of its metallic material of small thickness.

And the deep-drawing process itself, which is repeated as a multiple-step drawing process for forming the wave like pattern, enables to effectively form the mouth portion 4 in the central part.

Figure 3:
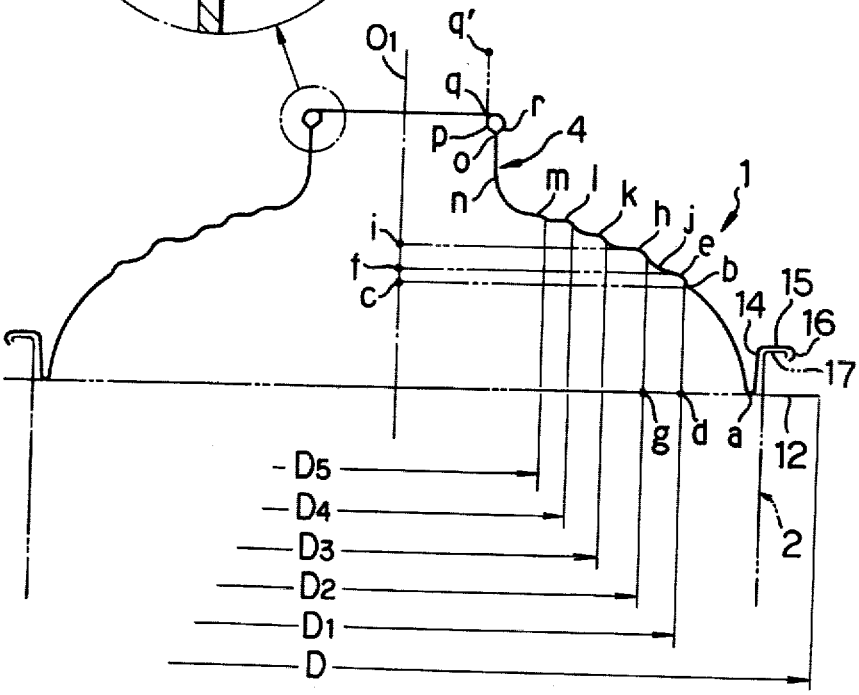
FIG. 3 is a schematic axial cross sectional view of a lid piece, integrally formed with a mouth portion, in accordance with this invention, and an enlarged vertical cross sectional view of an edge of the mouth portion.

The forming process of the upper piece 1 will be described in greater detail hereunder. The explanation of the process will be mainly limited, because of the symmetrical form of the vessel, to the right side half of a central line $O_1$, with reference to FIG. 3, a vertical and axial cross sectional view of the upper piece 1 with the mouth portion 4. A material blank 12 is, for example, an aluminum alloy (5052S) made thin plate coated with an epoxy resin (not shown) on both sides at a thickness of 3–4$\mu$ and having a diameter $D_1$ and a thickness 0.5 mm. This material is at first formed into abc shape by a press die; then a first drawing process is carried out with a punch of drawing diameter $D_1$ (shape def) for forming an annular convex pattern e with a smooth hill like section, the outer periphery of which annular convex pattern e of a hill like section is connected to a annular concave pattern b with a smooth inverted hill like section. A smooth hill like annular convex pattern h is next formed by a second drawing process with a punch of ghi shape with a drawing diameter $D_2$. In this process the convex pattern e formed in the previous process remains unchanged, consequently a smooth annular concave pattern j is naturally formed between the convex patterns e and h. Likewise annular convex patterns k, l, m are formed with punches of drawing diameters $D_3$, $D_4$, . . . . By those processes each annular convex patter e, h, k, l, m is formed on the body portion of the upper piece 1 of bowl shape, with the outer periphery of the punch used at each drawing process, to be a continued smooth and gentle wave like pattern, being combined altogether. In this multiple-step drawing process, the surface area of each section processed by drawing, one after another, shall be equal to each other.

Figure 4:
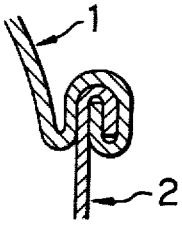
FIG. 4 is an enlarged vertical cross sectional view of the portion where the lid piece is joined to the main body piece.
Figure 4:
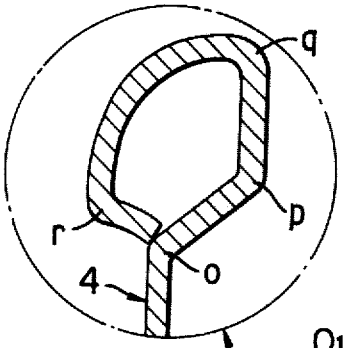

The mouth portion 4 can be obtained by forming the central part of the bowl like portion of the upper piece 1 into a form of mnopqro. A rolled up end of the mouth portion 4 is processed, after once forming the material into a cylindrical shape pqq', by trimming the tip portion and roll-forming the qq' portion outwardly to finally made a qro portion. The outer periphery of the bowl like portion of the upper piece 1 is provided with, for being connected to the lower piece 2, a cylindrical flange 14, an outwardly extended lateral flange 15, and a folding-back flange 16, being integrally formed. A laterally extended flange 17 formed on the upper end of the cylindrical portion of the lower piece 2 is contacted with the lateral flange 15 of the upper piece 1, then a double seaming process is applied to roll up the both flanges 15, 17, together with the folding-back flange 16, into a state shown in FIG. 4 in enlargement. The mouth portion 4 and the flanges 14–16 may be formed in advance of applying a deep-drawing process on the inverted bowl like body portion.

The inverted bowl like body portion of the upper piece 1 with the mouth portion 4 in this invention has a smoothly continued circular wave like convex-and-concave patterns, formed concentrically, and all the smooth hill like annular convex patterns e, h, k, l, m formed by the peripheral edge of the punches of different drawing diameters are left untouched on the surface of the upper piece 1 to enhance the rigidity and strength of the same. In other words, the annular waved patterns, convex-and-concave, function in reinforcing the upper piece 1. And besides, a final touch of the formation by drawing the material, i.e., eliminating the irregularities on the material occurred in the forming course, is not applied in this invention. The once formed convex patterns e, h, k, l, m on the material by the peripheral edge of the punches of different diameters are never bent in the reverse direction (not equalized in the height of the waves), so the convex places e, h . . . affected once by the pulling stress to have the material organization somewhat changed are not exposed to reverse compressing stress, leaving the coated surface unaffected, not being peeled off. As to the inside surface of the material the case is identical. It means shock-mark phenomenon can be completely prevented on both sides of the material, that is to say, on the outer surface of the lid deterioration of the appearance by the shock-mark is eliminated, and on the inside of the lid undesirable mixing of peeled pieces of coated material into the contained beverage or food which possibly deteriorates the same can be prevented. This invention thus enables to manufacture a lid piece with the mouth portion of a plate material coated with a resin, while keeping largely enhanced strength of the same.

The mouth portion of the vessel made in the central part of the lid, or an inverted bowl like upper piece 1, can be in this invention formed in a highly preferable way as stated hereunder. When first of all the upper piece 1 as a lid is press-formed by the stepped drawing process a cylindrical portion 23 having a top plate in the central part thereof is integrally formed. And in the middle part of the cylindrical portion 23 a circular step portion 24 is formed at the same time. Numeral 25 in FIG. 5 then designates an outer flange which will function as a joiner when the upper piece 1 is joined with the lower piece 2 by the double-seaming process.

Figure 5:
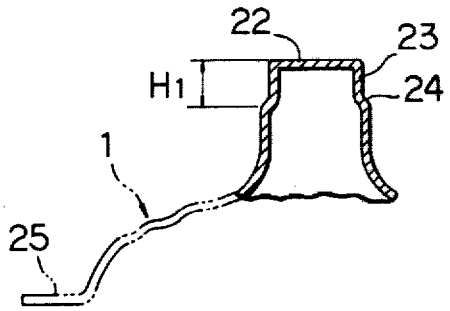
Figure 6:
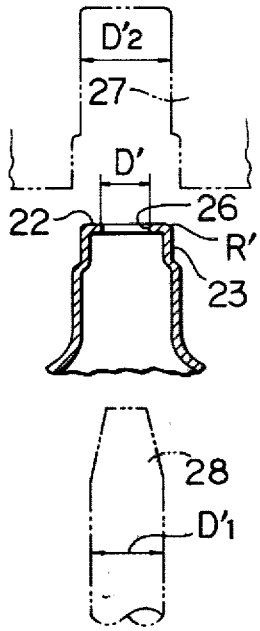
Figure 7:
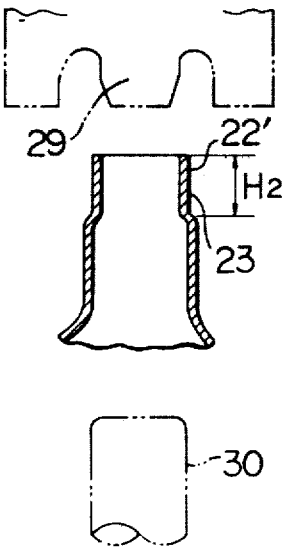
Figure 8:
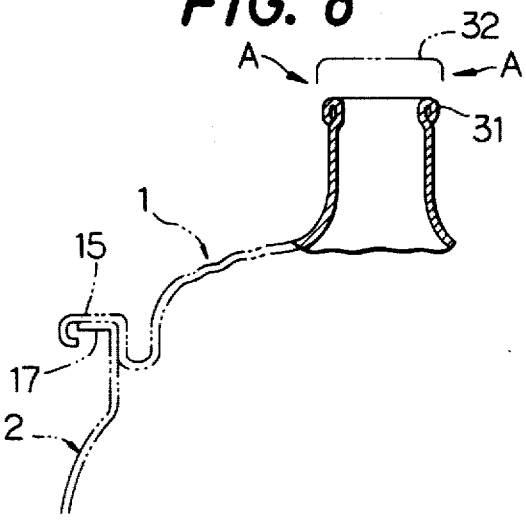

The top plate 22 is cutaway, with a punch and a die (not shown), to form a concentric hole 26 with a diameter D' in the central part thereof, as can be seen in FIG. 6. The left peripheral portion of the top plate 22 around the hole 26 is formed into a similar cylindrical form as the cylindrical portion 23 (this portion is called hereunder burling process). For this purpose a pair of upper die 27 and a lower die 28 are employed, and FIG. 7 shows how the cylindrical portion is formed by erecting the left outer peripheral portion of the top plate 22 into an integrated part with the cylindrical portion 23 already existed. Thus obtained integrated cylindrical portions 22, 23 can be curled outwardly by, for example, an upper die 29 for curling and a lower die 30 for cooperating the former to form a mouth portion almost circular in section for being capped with a crown. By being capped with a seal cap 32, made of for example aluminum thin plate, and sealed by pressure (caulked) in the arrow A direction on the outer periphery, a perfect gas-tight sealing is completed. During the various pressing processes before completing the mouth end 31, the flange 25 shown in FIG. 5 is processed additionally to become the flange 15 shown in FIG. 8 and in a later process the same is further processed to be, together with the flange 17 of the lower piece 2, caulked or double-seamed into a gas-tight sealing.

Figure 9:
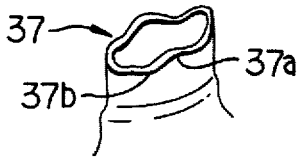
Figure 10:
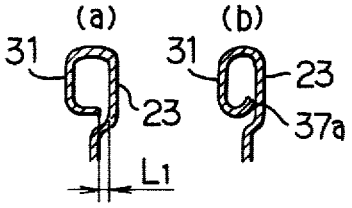

In the previously stated processes an important technological problem must be disclosed herewith. When the left peripheral portion of the top plate 22 around the hole 26 is erected upright to become a cylindrical portion 22' for being integrated with the cylindrical portion 23 (see FIG. 7), if the shoulder R' between the cylindrical portion 23 and the left part of the top plate 22 is completely straightened, then appear wavy irregularities 37 on the top of the cylindrical portion 22' as shown in FIG. 9 due to the directionality of the material, showing mountain portions **37*a* and valley portions 37*b*. If the curling process is forcibly carried out without correcting the irregularities, a gap $L_1$ is created due to the valley 37*b*, as shown in FIG. 10** (*a*) between the plate tip and the cylindrical portion 23, and the mountain **37*a* will on the contrary forcibly abuts against the cylindrical portion 23 as shown in FIG. 10** (*b*), to finally make the mouth end 31 irregular, in its cross-sectional view, at various points on the circumference thereof. It means that the mouth end 31 is not perfectly finished, being imperfect in circulality, leading to an unsatisfactory sealing when the vessel is crowned. Causes for the disadvantage can be found in a fact that the shoulder R' can be erected perfectly in one part but can not be done so in another part. If a forcible erecting is attempted to make a complete cylindrical form, there can be inevitably wavy irregularities on the plate end, with a result of uneven cross-sectional view of the mouth end 31 appearing.

This invention recommends for that reason, in the forming process of this part, the following method. By taking advantage of the excellent technology in this invention, which enables the form and the position of the shoulder R′ to be highly precise when forming the cylindrical portion 23 having the top plate 22, and enables to get the out of roundness as well as the concentricity of the hole 26 when it is cut concentrically with the top plate 22, the shoulder R′ must be formed such that when it is erected upright there remain an annular step, not being completely straightened, and consequently the plate end, when the left peripheral portion of the top plate 22 is erected to the cylindrical form, will not have irregularities 37.

Figure 11:
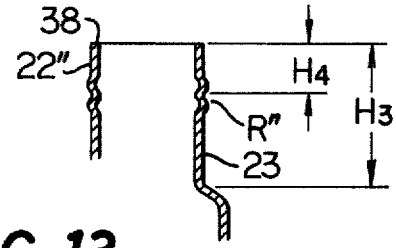

This will be illustrated, with reference to FIGS. 6 and 11, hereunder. The method of punching the concentric hole 26 with the diameter $D_1$ in the middle part of the top plate 22 is just identical to the earlier stated one. An important difference lies in the way of erecting (extending) the left peripheral portion of the top plate 22, and the secret lies in, first of all, decreasing the external diameter $D'_1$ of the lower die 28 a little or slightly increasing the internal diameter $D'_2$ of the upper die 27, when erecting the left peripheral portion of the top plate 22, in order to make the erected cylindrical portion 22″ slightly different from the cylindrical portion 23 in its external diameter. When the external diameter $D'_1$ of the lower die 28 is decreased a little than the conventional one the internal diameter of the cylindrical portion 22″ becomes smaller than that of the cylindrical portion 23 and the shoulder R′ is remained as a step R″, because it is not fully extended (or erected). In other words, a part of the curved portion of the shoulder R′ is left maintained between the cylindrical portion 22″ and the cylindrical portion 23. It means that a partly stepped cylindrical portion is made on the forward side of the cylindrical portion 23. When the internal diameter $D'_2$ of the upper die 27 is slightly increased than the conventional one, the internal diameter of the cylindrical portion 22″ becomes identical to that of the cylindrical portion 23, leaving in the middle a slightly diameter-increased step portion R″ to be formed.

By means of an erecting formation of the left peripheral portion of the top plate 22, with the shoulder R′ left as an annular step, the summed height $H_3$ of the cylindrical portion 23 and the cylindrical portion 22″ will be made slightly smaller than the corresponding height $H_2$ (see FIG. 7) in the conventional method, however, the top edge 38 (upper edge) will be smooth i.e., not wavy at all. It can be explained such that the shoulder R′ will be scarcely extended, while the cylindrical portion 22″ is formed, and the height of the stepped portion R″ which has been changed from the original shoulder R′ will be almost uniform around the newly formed cylindrical portion (between the cylindrical portion 23 and the cylindrical portion 22″). It consequently causes the final height of the cylindrical portion 22″ to be uniform, surely preventing the wavy irregularities of the top edge 38. Curling process applied to such a uniformly formed cylindrical portion (which includes 23 and 22″) will bring about a uniformly curled mouth end having a nearly perfect circular cross section. In this instance the curling may be one like in FIG. 10 (*a*) or like in FIG. 10 (*b*) in its cross sectional shape. In any way, a uniform curling around the whole circumference of the mouth end can be attained, because the top edge 38 being perfectly in a plane free from irregularities in height immediately before the curling process.

As explained in detail in the above, the burling process, which is applied to the left portion of the top plate after the concentric hole 26 has been punched in the top plate 22, must be carried out to leave the shoulder R′ as a not-extended step portion so as to be uniform in its height around the whole circumference. By this method the plate top 38 can be smooth, being in a plane, which enables the later performed curling process to be perfect, and the uniformly curled mouth end 31, having a uniform cross-sectional form around the whole circumference, greatly enhances the sealing effect of the container itself.

The lower piece 2 of the vessel (container) in this invention is similarly to the upper piece 1 made of a metallic plate with a thickness of 0.3–1.0 mm, preferably 0.3–0.5 mm, by means of a deep-drawing process. Preferable way of drawing operation will be described hereunder, which includes, roughly speaking, three major processes, i.e., deep-drawing a punched plate of aluminum alloy of 0.3–1.0 mm thickness coated with a epoxy resin into a shape of the main body piece or member, annealing the formed main body portion at a temperature of 250°–350° C. for 1–5 minutes, and forming additionally or finishing the annealed main body piece or member.

Describing further in detail, a certain coil plate of aluminum alloy (A 3004 or A 5052) with a thickness, for example, of 0.4 mm, having a coating of epoxy-urea resin (thickness 4μ) is brought about in place, in the first process. In this instance the thickness of the coil plate may be between 0.3 and 1.0 mm, and as the epoxy resin preferable epoxy-urea resin may be adopted. The thickness of the coating may be freely selected in accordance with the use, and the coating may be applied only to the inside surface of the container.

The second process is punching by means of a blanking machine to get a circular plate material of a predetermined dimension.

The punched material plate is delivered to a transfer press machine, wherein the third, the fourth, and the fifth processes are performed in the order to gradually approach, through a series of deep-drawing processes, the shape of a bottomed cylindrical main body.

The sixth process is for forming, and the seventh process for trimming. The sixth process may be omitted according to the circumstances.

The eighth process is an annealing process in a continuous annealing furnace, wherein the operation conditions are 290° C. in temperature, 1.5 minutes in time duration. As later described the temperature may be in the range of 250°–350° C. and the time duration may be 1–3 minutes according to the variation of the plate thickness and the composition of the coating material.

The ninth process is a bulging process with a bulging press, wherein the main body already annealed is bulged by urging from inside by means of a rubber die put inside the main body against an external die embracing the main body in order to get a targeted barrel form. Stretching rate observed in this bulging process is, for example, 6.5%. This stretching can be obtained without affected by the so-called stretch strain mark (SS mark) thanks to the foregoing annealing in the eighth process. If the annealing in the eighth process is omitted numerous stretch strain marks appear on the external surface of the main body piece.

In the aforementioned preferable embodiment the characteristic conditions adopted are the thickness selected in the range of 0.3 to 1.0 mm, the annealing temperature applied in the eighth process on the material plate with a coating of an epoxy resin within the range of 250°-300° C., and the time duration therefor which is specified between 1 and 3 minutes. By observing those conditions the main body can attain, after the largest possible deep drawing ratio (for example the drawing ratio 2.25) to the aluminum alloy material has been performed in the third, fourth and fifth processes (steps), the stretching rate of 6.5% in the ninth bulging process and the deterioration or burning (scorching) due to oxidation of the resin coating can be surely avoided.

When the annealing temperature exceeds 350° C., in either case of epoxy-phenol resin or epoxy-urea resin coated, the coating layer itself is burnt or scorched to discolor the coated surface. Besides, it causes to give some unagreeable flavor to the contained food or beverage. Annealing at a temperature below 250° C. the time duration required is elongated to accelerate the discoloration of the coating, and the time duration of annealing exceeding 5 minutes burns or destroys the coating, irrespective of the temperature at which the annealing is carried out. Annealing over 5 minutes results often remarkable carbonization of the coating film. On the contrary, annealing for less than 1 minute brings about insufficient effect of annealing, being far short of expectation. The best preferable conditions of annealing in a case, wherein an aluminum alloy plate 21 of 0.4 mm thickness (for example A 3004 or A 5052) coated with epoxy resin at a thickness of 4$\mu$ is required to show a drawing ratio up to the fifth process (step) 2.25 and to give a stretching rate in the ninth process of 6.5%, are 290° C.±10° C. in temperature and 1.5 minutes in its time duration. At the above-mentioned conditions no destroying of resin coating is observed and no undesirable flavor is found given to the contained matter, to the best of the inventor's knowledge.

The above-mentioned method for obtaining a container made of aluminum (including aluminum alloys) coated with an epoxy resin is highly suitable for doing the deep-drawing process and for preventing the destroying of the coated film. Even when the annealing process which is carried out within the course for partially recovering the material stretching is taken into consideration, this method is still sufficiently effective in preventing the destroying of the coating for the containers used for foods. This invention has thus succeeded in providing a container excellent in corrosion resistance, wearing resistance, etc., and in giving a good appearance.

The continuous annealing furnace of heated-atmosphere-cycling type, which is utilized in the eighth process for realizing the invented method, can be replaced by a heating method by means of infrared rays irradiation or an induction heating method by means of high frequency for the purpose of heating only outer side of the container which is advantageous in preventing to the greatest extent the destroying of the coated resin on the inside surface during the course of annealing. It is an innegligible thing for a container for foods which attaches an importance to the prevention of flavor-giving to the contained matter.

Another great merit derived from the above method for making an upper piece 1 and a lower piece 2 from an aluminum alloy plate coated with a resin is a complete elimination of lubrication oil in the course of drawing process, which can not be expected in the ordinary drawing processes, because of the coated resin itself functioning as a good lubricating matter during the drawing operation. This elimination of lubricant makes it possible consequently to do away with the cleansing and drying operation usually required for the containers for foods.

Regarding the bulging process of the container which is preferably applied to the lower piece 2 to bulge the barrel portion thereof for swelling outwardly in an arch shape in cross-section, some comments will be made regarding its limitation and cautions.

The greatest diameter of the arch like bulged portion of the lower piece 2 in its center must be within the limit of 1.1 times as large as the smallest diameter of the lower piece 2 which lies, concretely speaking, in the joined portion of the lower piece 2 with the upper piece 1. The bulging beyond this limit is liable to give rise to a problem of cracking in the material.

In the actual operation of this bulging process an undesirable possible occurrence of stripes or streaks on the surface of the lower piece 2 from the use of the split die must be carefully prevented. This precaution required for keeping the commercial value of the manufactured articles will be described hereunder.

This problem has been essentially solved by utilizing a split die which, used for bulging the lower piece 2, is provided with a groove formed in the abutting or joining portion of the two parts. The depth and width of the groove must be carefully determined from the consideration of the material quality and thickness to be processed and the quality of the urethane rubber employed as an inside die, such as elasticity and others, so that the material to be processed may not touch the bottom of the groove when it is pushed out into the groove by the urging force of the inside die. By avoiding the touch with the groove bottom a smooth and beautiful rib of arcuate cross-sectional shape can be formed there instead of the conventional unseemly stripe (streak). The beautiful rib made on the joining place will make, with the aid of grooves disposed at other places than the die-joining position, a series of straight grain pattern. This will be illustrated by an embodiment.

Figure 12:
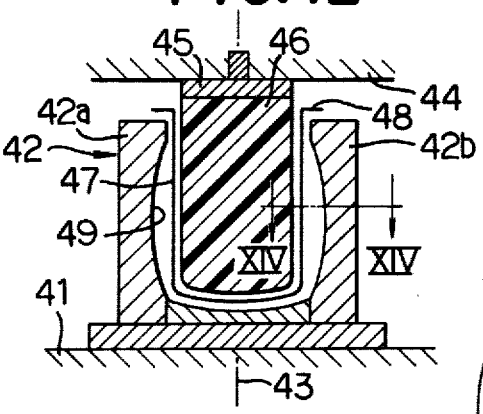
FIG. 12 is an axial cross sectional view of a mold immediately before applying the bulging process.

In FIG. 12 the numeral 41 designates a bolster, on which a mold 42 is fixed with a plurality of bolts, and a pair of splittable body portion of the mold **42*a*, 42*b* are movably placed there in the arrow marked lateral directions (right and left) from the boundary line designated at 43. Numeral 44 designates a ram movable up and down. A holder 45 connected to the ram 44 is provided with an inside die (inside mold) 46 of urethane rubber. A cup-like material 47 to be formed into a lower piece 2 made of aluminum thin plate is provided, on the upper end thereof, with an integral lateral flange 48 for resting. When everything is ready as in FIG. 12 the ram 44 is lowered to expand the inside die 46 of urethane rubber for bulging in turn the cup-like material 47 by urging the same along and against an inside surface 49 of the mold 42. Lifting up of the ram 44 accompanied by a simultaneous opening of the two parts 42*a*, 42*b* of the mold 42 will leave a formed lower piece (indicated with 40 in FIG. 13**).

Figure 13:
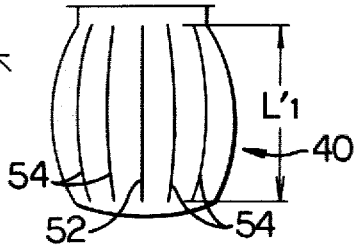
FIG. 13 is an elevational view of a barrel, main body of the lower piece, obtained in the bulging process.
Figure 14:
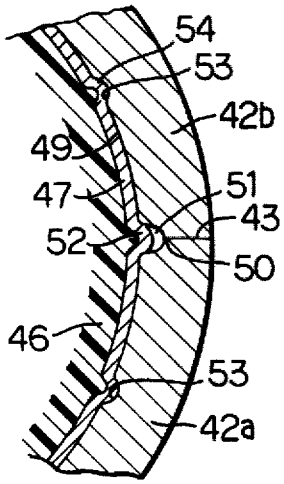
FIG. 14 is an enlargement of the cross section taken along the XIV—XIV line in FIG. 12.

With reference to FIG. 14, which shows an enlargement of the cross-sectional view of FIG. 12 taken along the line XIV-XIV, wherein the bulging formation is finished by the urethane rubber 46 expanded to the maximum extent, a part of the cup-like material 47 is swollen by the ruging force of the inside die 46 out into a groove 51 of arcuate cross-sectional shape which is engraved in advance by etching or like method at the joining place 50 of the mold 42. A bead 52 formed by the above-mentioned swelling of the cup-like material 47 into the groove 51 does not reach the groove bottom 50, i.e., the joining place of the two parts of the mold 42, so the bead 52 has a smooth and uniform arcuate shape in cross-section in accordance with the natural expansion of the inside die 46 of urethane rubber. It completely prevents the external surface of the bead 52 being spoiled by the possible vertical streaks, even when the joining place 50 is somewhat offset or inprecise. On both lateral sides of the groove 51 a plurality of rather shallow grooves 53 are engraved with an identical interval from each other, wherein the swollen material 47 reaches the bottom of the grooves 53, when it is urged by the inside die 46, to form a bead 54 . . . . Those beads 52, 54 . . . will form the aforementioned straight grain pattern, as shown in FIG. 13. Those beads 52, 54 . . . are formed only ranging the bulged section $L'_1$ in the barrel main body 40 (in FIG. 13), and they become gradually lower to finally fade out at the upper and lower extremity of the bulged section $L'_1$.

By means of employing the split mold 42 which is provided with, in its joining place 50, the groove 51 engraved in advance, the bead 52 is made positively or purposely while the bulging formation is carried out on the material 47. This is successful in preventing the occurrence of unseemly streaks on the joining place of the mold 42, which has been unavoidable in the prior art, and consequently in greatly improving the appearance of the barrel main body 40. The formation of the straight grain pattern, which is made by the bead 52 and the other parallel beads 54 . . . cooperating the former, has greatly enhanced the commercial value of the barrel 40. Various types of grooves or pattern designs may be engraved in advance on the inside surface of the split mold 42 for getting desired beads or patterns on the varrel 40 by virtue of the inside die of urethane rubber 46, so that the bead 52 formed on the material 47 may not touch the joining place 50 of the mold 42, i.e., the bottom of the groove 51 has not only completely prevented the occurrence of the undesirable streaks but also has completely eliminated the problems regarding the deterioration of strength and maintenance of safety. It also contributed very much in economizing the mold manufacturing cost, because this method has relieved the mold from the requirement to be absolutely precise. This invention is also applicable to the hydraulic pressure type bulging formation method.

In this invention the joining of the upper piece 1 and the lower piece 2 is, as stated earlier, preferably executed by the double-seaming process. However, the method of joining the two is not limited to that, but any suitable ones are allowable, for example, an adhesive may be used. Regarding the double-seaming process employed in this embodiment, a detailed description will follow hereunder. For joining the upper piece 1 in a most desirable way to the lower piece 2, (1) a cylindrical outside wall of a recess (a valley portion) which is formed around the lower opening of the upper piece 1 is so made as to be gradually small-diametered toward the bottom portion (called bottom wall) of the recess, that is, slightly tapered inwards, (2) the bending or turning-back radius of the bottom wall is made approximately equal to the thickness of the material plate, (3) the angle formed between the outside wall and the inside wall of the recess is made as small as possible within the sphere which allows the fitting-in of a chuck, and (4) the double-seaming process is carried out, after having substantially contacted the outside wall of the recess closely to the inside surface of the opening of the lower piece 2 by means of inserting of the annular chuck, with a double-seaming roll applied to the joining place from outside under pressure.

Figure 16:
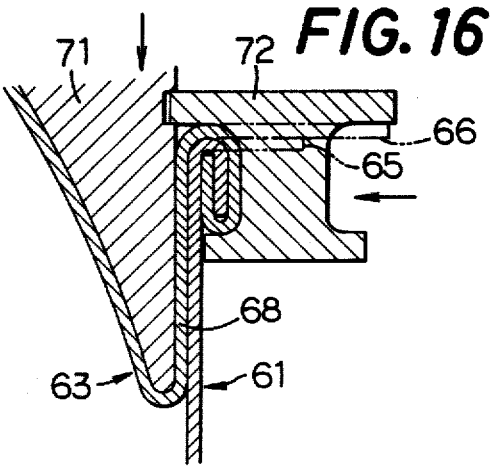
FIG. 16 is an explanatory view for showing the double seaming process applied to the joining place shown in FIG. 15.
Figure 15:
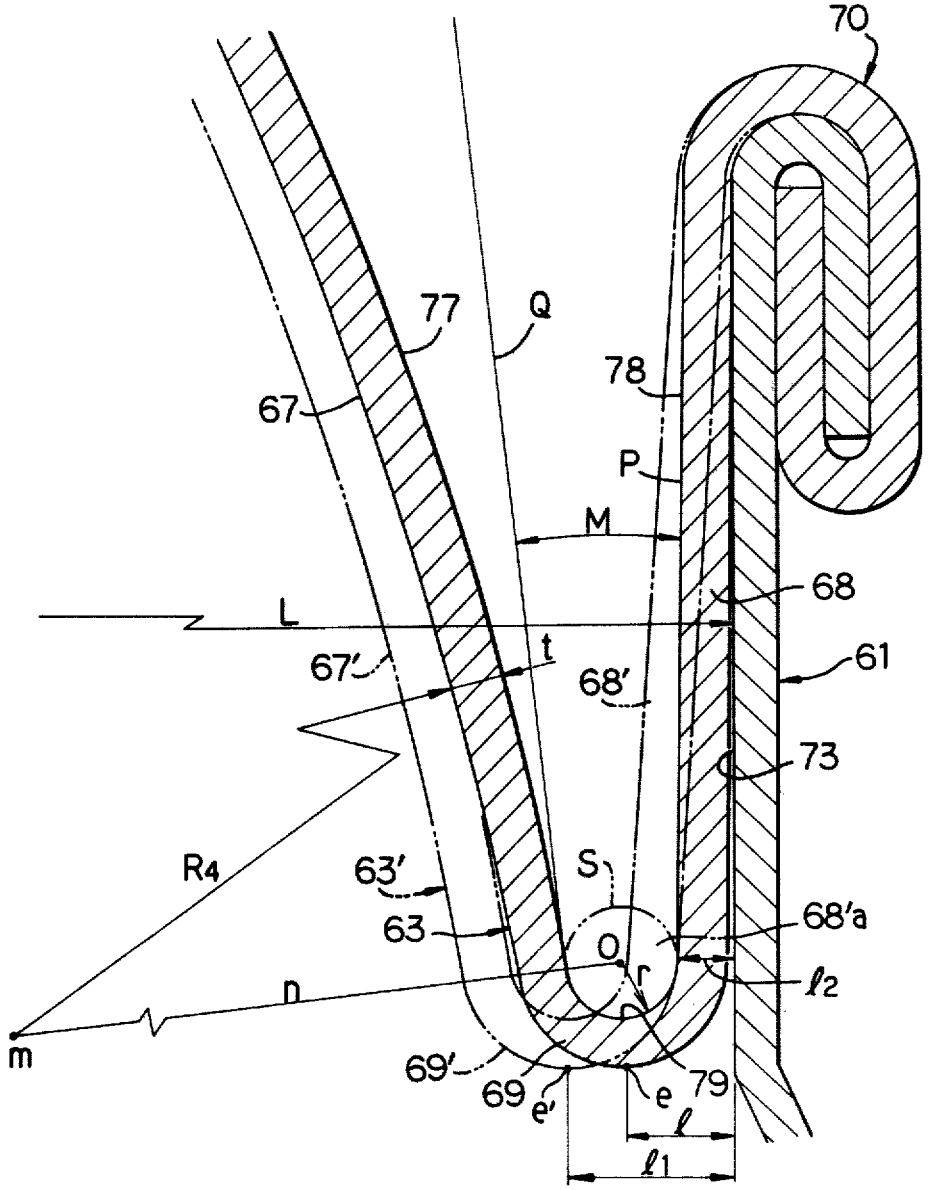
FIG. 15 is an enlargement corresponding to FIG. 4 which shows the portion where the upper piece is joined to the lower piece.

This process will be detailed with reference to FIGS. 15 and 16. A two-dot-chain-lined portion 63' in FIG. 15 shows the recess before the insertion of the chuck 71 (see FIG. 16). The recess 63 illustrated in a solid line is in its seaming-completed state.

The inventors of this invention confirmed from a series of strenuous experiments that the bending radius r of the bottom wall 69 of the recess 63 should be as small as possible for making the recess 63 strong (the strength against being rolled up), and that the bending radius r can not practically be made smaller than the thickness t of the plate. So the radius r was determined to be approximately equal to the thickness t (0.5 mm) of the plate. Letter M designates an angle formed between a line P and a line Q (in FIG. 15), which are located in a plane including an axial line of the container, wherein P is a straight line in the inner surface 78 of the outside wall 68 of the recess 63 and Q is a straight line which contacts from left a circle S which is inscribed on the upper side of the bottom wall 69 and also contacts from right (in FIG. 15) an arc which is formed by the outer surface 77 (right side in FIG. 15) of the inside wall 67 of the recess 63, with a radius ($R_4+t$), at a point where the arc contacts the circle S. In other words, Q indicates a straight line which is perpendicular to a line n linking the center O of the circle S and a center n of the arc passing the outer surface 77 of the inside wall 67.

The inventors also found based on the experiments that the angle M should be as small as possible to improve the strength of the recess 63 and should practically be less than 10° when the container is used as a beer container, because its inner pressure is 4.2 $Kg/cm^2G$ or so. However, if the angle M is made less than 0° the insertion of the chuck 71 into the recess 63 for applying the double-seaming becomes extremely difficult. In this embodiment where the diameter of the barrel portion (inner diameter of the lower piece 2) L=15.5 cm, the angle M is determined within the range of 0°-10°. And the radius $R_4$ (shoulder curve) of the outer surface 77 is determined within the range $\frac{1}{4}$-1/10 of the barrel diameter L, which is very contributive to improving the degree of pressure resistance of the container. And the radius $R_4$ in this embodiment is numerically set at $R_4=(0.17-0.18)L$. Besides, the force acting on a unit of length of the recess 63 and the seaming place 70 (in the circumferential direction) caused by the inner pressure is proportionate to the barrel diameter L, therefore the increasing of the L requires a corresponding decreasing of the angle M.

If and when the angle M and the radius r are minimized in accordance with the above-mentioned requirements, distance l between the lowest end e of the bottom wall 69 and the inner surface 73 of the opening 61 of the lower piece 2 becomes extremely small (approximately 1 mm), so the insertion of the recess 63 in a state illustrated with a solid line into the opening 61 of the lower piece 2 becomes very difficult. As a countermeasure for that difficulty the outside wall 68' of the recess 63' is slightly tapered inwardly as it approaches the bottom wall 69', i.e., it is inwardly inclined a little, so that the lowest end 68'a of the outside wall 68' may be separated from the inner surface 73 of the opening 61 by a distance of $l_1$, approximately 0.5 mm. As the distance $l_1$ between the lowest end e' of the bottom wall 69' and the inner surface 73 of the opening 61 is expanded up to 1.5 mm by making the recess 63' alienated from the opening 61 as mentioned above, this facilitates the inserting of the recess 63' into the opening 61.

After the recess 63' is inserted into the opening 61, the annular chuck 71 is inserted into the recess 63' from above for contacting the outside wall 68 almost closely to the opening 61, and then a double-seaming roll 72 is applied from outside (from right side in FIG. 16) on flanges 65 and 66 under pressure to carry out the double-seaming.

The outside wall 68 will be, when the chuck 71 is lifted at the finishing of the double-seaming process, alienated a little from the opening 61 due to the spring back phenomenon. But it will not affect at all the gas-tight sealing of the double-seamed portion 70.

In accordance with the above-mentioned double-seaming process in this invention, the angle M between the inside wall 67 and the outside wall 68 of the recess 63 and the bending radius r of the bottom wall 69 were both made very small. It remarkably enhanced the strength of the recess 63 against being rolled up to loosen the sealing and consequently the anti-pressure capability. Besides, the tapering of the outside wall 68' toward the bottom wall 69' before the recess 63' being inserted into the opening 61 made the inserting of the recess 63' into the opening 61 extremely easy, irrespective of the diminishing of the angle M and the radius r.

What is claimed is:

1. A metallic pressure vessel capable of withstanding 3–4 kg/cm$^2$ internal pressure, comprising:

a main body piece of bottomed cylindrical form comprising a single piece of sheet aluminum or aluminum alloy having a thickness between 0.3 mm and 1.0 mm and having a resin coating layer, which is thin relative to the thickness of the sheet, on the surface thereof, the side portion thereof being bulged outwardly in an archshape in its cross section; and a lid piece made of a single piece of sheet aluminum or aluminum alloy having a thickness between 0.3 mm and 1.0 mm and having a relatively thin resin coating layer on the surface thereof, and being secured to the upper opening of said main body piece by means of a gas-tight attachment, thereby covering same, said lid piece being in the shape of an inverted bowl-like portion, the diameter of which gradually decreases upwards from the portion thereof attached to said main body piece, having a plurality of annular concentrically formed convex-and-concave patterns, which continuously describe a gentle and smooth wave in the cross-sectional view thereof, and a mouth portion integrally formed with said inverted bowl-like portion as a protrusion extending outwardly from the central part thereof, wherein the bottom of said bowl-like portion of said lid piece, at the point of said gas-tight attachment to said main body, has a recess the bottom of which is substantially U-shaped in axial cross-section of the vessel and which bottom is disposed a substantial distance below said attachment, wherein the exterior arm of said recess extends up from said bottom and then into said attachment, and wherein the interior arm of said recess extends from said bottom in a curve which is convex as viewed from outside the vessel and is arcuately bowed in axial cross-section, said curve continuing to a height a substantial distance above said attachment at the uppermost portion of said main body piece, thereby forming a substantially round shoulder portion, said plurality of annular convex-and-concave patterns beginning at the uppermost portion of said shoulder and extending to a point near said mouth portion.

2. A metallic pressure vessel as claimed in claim 1, wherein the bottom of said main body piece is made into a shallow bowl-like shape outwardly curved, and at least three substantially oval-shaped protrusions, for stably supporting the vessel when placed on a flat surface, are disposed protruding outwardly along a circular line having its center at the center of said bottom, and furthermore a reinforcing bead of radially elongated shape is disposed radially between each pair of neighboring protrusions, each of said beads extending from a point near the center of the bottom and extending out substantially to a circle enveloping said protrusions.

3. A metallic pressure vessel claimed in claim 2, wherein each said bead is an inwardly recessed groove from said bottom of said main body piece.

4. A metallic pressure vessel claimed in claim 1, wherein said mouth portion integrally formed in the central part of said lid piece has a curled end portion, including an empty space therein in its cross sectional view, for receiving a sealing cap thereon.

5. A metallic pressure vessel claimed in claim 1, wherein said main body piece and said lid piece are gas-tightly joined into a united body by means of a double-seam.

6. A metallic pressure vessel claimed in claim 1, wherein the largest diameter at the central part of the bulged side portion in an arch shape of said main body piece is not larger than 1.1 times of the smallest diameter at an end of the arch like bulged portion.

7. A metallic pressure vessel claimed in claim 1, wherein said mouth portion is made such that a cylindrical portion having a top plate is formed in the central part of a circular metal sheet, after or before said inverted bowl like portion is formed by a deep-drawing process in said metal sheet, by a vertical pressing die, then the central part of the top plate is concentrically punched, and the left peripheral portion of the punched top plate is upwardly erected into a cylindrical form so that a shoulder may be left as an annular step, and finally the cylindrical portion including said annular step is outwardly curled.

8. A metallic pressure vessel claimed in claim 1, wherein said main body piece is outwardly bulged by means of a bulging formation process.

9. A metallic pressure vessel in accordance with claim 1, wherein the radius of curvature of said shoulder portion, in axial cross-section, is ¼ to 1/10 of the diameter of said main body piece at the upper opening thereof.

10. A metallic pressure vessel in accordance with claim 1, wherein the radius of curvature of the bottom of said U-shaped recess is substantially equal to the thickness of said lid piece.

11. A metallic pressure vessel in accordance with claim 10, wherein the line which is perpendicular to a line that passes through the centers of the radius of curvature of said shoulder portion and the radius of curvature of the bottom of said recess forms an angle of 0°–10° with with the exterior arm of said U-shaped recess.

* * * * *